US007223140B2

(12) United States Patent
Doi

(10) Patent No.: US 7,223,140 B2
(45) Date of Patent: May 29, 2007

(54) SCULLING OAR

(76) Inventor: Atsushi Doi, 6-51-12, Ryokuen, Izumi-ku, Yokohama-shi, Kanagawa 245-0002 (JP)

( * ) Notice: Subject to any disclaimer, the term of this patent is extended or adjusted under 35 U.S.C. 154(b) by 0 days.

(21) Appl. No.: 10/538,460

(22) PCT Filed: Dec. 11, 2003

(86) PCT No.: PCT/JP03/15862

§ 371 (c)(1),
(2), (4) Date: Jun. 10, 2005

(87) PCT Pub. No.: WO2004/052722

PCT Pub. Date: Jun. 24, 2004

(65) Prior Publication Data

US 2006/0148341 A1 Jul. 6, 2006

(30) Foreign Application Priority Data

Dec. 11, 2002 (JP) ..... 2002-383121

(51) Int. Cl.
*B63H 16/04* (2006.01)

(52) U.S. Cl. ..... 440/102

(58) Field of Classification Search ..... 440/101, 440/102, 104, 106, 108, 109
See application file for complete search history.

(56) References Cited

U.S. PATENT DOCUMENTS

| | | | | |
|---|---|---|---|---|
| 2,213,538 | A * | 9/1940 | Whitehead | 416/74 |
| 2,696,797 | A * | 12/1954 | Whidden | 440/14 |
| 3,086,492 | A * | 4/1963 | Holley | 440/15 |
| 6,938,567 | B1 * | 9/2005 | O'Donnell | 114/39.12 |

FOREIGN PATENT DOCUMENTS

| | | | |
|---|---|---|---|
| DE | 4227198 | A1 * | 2/1994 |
| JP | 30-2992 | C2 | 11/1897 |
| JP | 38847 | Z2 | 3/1916 |
| JP | T15-29606 | Y1 | 9/1926 |
| JP | 12-12176 | U | 8/1937 |
| JP | 28-6522 | Y2 | 7/1958 |
| JP | 49-134096 | | 12/1974 |
| JP | 62-141599 | U | 9/1987 |
| JP | 7-52883 | A | 2/1995 |

* cited by examiner

*Primary Examiner*—Jesús D. Sotelo
(74) *Attorney, Agent, or Firm*—Brooks Kushman P.C.

(57) ABSTRACT

An object is to provide a Ro-scull which can suppress a decrease in thrust force by water resistance generated during turn-over operation and can realize high-speed cruise of a boat. The Ro-scull has a Ro-arm 1 and a Ro-blade 2 having a flat part 12 perpendicular to the Ro-arm 1. The Ro-arm 1 is attached to an upper end portion of the Ro-blade 2 from an obliquely lower side. Namely, the Ro-arm 1 and the Ro-blade 2 are joined to each other while the Ro-arm 1 "receives" the Ro-blade 2. A Ro-handle 3 is arranged not on the upper surface side but on the lower surface side of the Ro-arm 1.

11 Claims, 15 Drawing Sheets

(a)

(b)

(a)

(b)

(c)

SCULLING OAR

TECHNICAL FIELD

The present invention is an invention related to a Ro-scull (or yuloh) (i.e., a sculling oar) which is operably attached to a ship in order to manually propel the ship, particularly a small boat.

BACKGROUND ART

It is thought that the Ro-scull which is a traditional manually rowing apparatus was brought to Japan from China at around a time before the Kamakura period. Since the Ro-scull was brought to Japan, the Ro-scull had been gradually improved, and the final form of the Ro-scull was completed in the early Edo period. Then, the form of the Ro-scull has been kept in substantially the same shape.

The Japanese Ro-scull has two features: (1) two rods of materials are used while being joined together; and (2) the two rods of materials thereof are joined to form a bent configuration.

Particularly, the Ro-scull having the above features is called as "Tsuguro (joined Ro-scull)." On the other hand, the Ro-scull in which two rods of materials are not used is called as "Saoro (rod Ro-scull)."

FIG. 6 shows a structure of the conventional Ro-scull.

The conventional Ro-scull consists of two large parts and two small parts. Referring to the perspective view of FIG. 6, each structure will be described.

In FIG. 6, the reference numeral 101 denotes a Roasi (hereinafter, Ro-blade or yuloh blade) which paddles the boat, and the Ro-blade 101 has a spatula-shaped flat part 110. The reference numeral 102 denotes a Roude (hereinafter, Ro-arm or yuloh arm) which is rigidly fixed to the Ro-blade 101 so as to be substantially horizontally held when the flat part 110 is orientated to an obliquely upward direction. Near a joint portion between the Ro-blade 101 and the Ro-arm 102, there is no flat part existing, but there is a part 120 (usually known as Ireko (insert)) having a round shape. A user puts the part 120 on a shaft support part 201 (usually called as Robeso (tholepin) or Rogui (Ro-stake or yuloh stake) provided at a rear end portion of a boat 200, (or the part 120 is rotatably supported by the shaft support part 201). The operator of the boat operates the Ro-arm 102 from side to side, thereby moving the Ro-blade 101 from side to side with the shaft support portion working as a pilot.

A small projected Rozuka (Ro-handle or yuloh handle) 103 is rigidly fixed onto the upper surface of the Ro-arm 102 and the Ro-handle 103 is used with a rope called Hayao 104 being tied thereto. The other end of the Hayao 104 is rigidly fixed to the bottom side of the boat, and the Hayao has a function of transmitting a thrust force to the boat when the thrust force is generated while the Ro-scull is operated.

The action of the conventional Ro-scull having the above structure will be described below.

The operator operates the Ro-scull arm 102 from side to side so that the flat part of the Ro-blade 101 is inclined with respect to an advancing direction. FIG. 7 shows the movement of a cross section of the Ro-blade 101 in the time-series order at the position where the Ro-blade is in contact with a water surface when the operator operates the Ro-scull. Assuming that the advancing direction of the boat is the lower side of the drawing, a to c in FIG. 7 show the states each in which the Ro-blade 101 is moved leftward with respect to the advancing direction of the boat, i.e. a to c in FIGS. 7 show a transition when the operator moves the Ro-arm 102 rightward. In the cross section of the Ro-blade 101, the sign f denotes a front edge in the advancing direction of the Ro-blade 101, and the sign r denotes a rear edge in the advancing direction of the Ro-blade 101.

A water flow generated in such a case relative to the Ro-scull is shown by a water flow 300 in (a) of FIG. 8.

As can be seen from the foregoing figure, a difference of flow in the water flow is generated between the top surface and the bottom surface of the flat part 110 of the Ro-blade 101 by obliquely moving the Ro-blade 101. The difference in the water flow creates a force similar to the force called "lift force" in an aircraft and the like, whereby, a thrust force in a direction of an arrow 400 is generated. When, thereafter, the movement of the Ro-blade 101 is changed from the leftward to the rightward with respect to the advancing direction, namely, when the moving direction of the Ro-arm 102 is changed, the Ro-blade is moved as shown in d to f of FIGS. 7.

In this case, a water flow 301 is created as shown in (c) of FIG. 8, and, as expected, the thrust force is generated in the direction of an arrow 401 similar to the direction of the arrow 400.

At a point in which the moving direction of the Ro-blade 101 is changed from the left to the right (the point between c and d of FIG. 7), it is necessary that the inclination of the Ro-blade is reversed (usually called as Kaeshi (turn-over)).

As can be seen from the above, among the manually rowing methods such as a paddle and an oar, the Ro-scull is the most functional in that the hydrodynamic lift force is used as the thrust force.

In an ideal condition, it is known that the lift force (thrust force) generated in the above-described manner is ten times as large as the drag force generated. Namely, the lift is generated ten times the rowing force.

Although the lift force is transmitted as a thrust force to a stern, the operator does not sense the thrust force by an operator's arm because the Hayao 104 and the fulcrum of the Ro-scull receive the thrust force. Further, unlike other manually rowing apparatuses, the Ro-scull has no wasted motion because the thrust force is generated in both directions of the reciprocating motion.

However, in the conventional Ro-scull, the flat part 110 obstructs the water flow at the point of the turn-over. In this case, as shown in (b) of FIG. 8, the water flow orthogonally hits the flat part 110 of the Ro-blade 101, so that resistance caused by the water flow is largely increased. In addition, large vortexes 302 are generated on the downstream side of the water flow, which results in the decrease in the thrust force, and whereby, the thrust efficiency is remarkably decreased.

In particular, because the vortexes are radically generated with the increasing speed of the boat, the thrust efficiency worsens as the speed of the boat is increased, and actual high-speed cruise by the thrust by the Ro-scull becomes difficult.

Therefore, in the case of the manually rowing boat with the Ro-scull, there is a problem that the speed of the boat becomes slower when compared with the oar which generates the thrust force on the side of the boat.

DISCLOSURE OF THE INVENTION

In view of the foregoing, an object of the invention is to provide a Ro-scull (i.e., a sculling oar), in which the operator is required to use only a small force by suppressing the resistance caused by the vortexes to the minimum during the turn-over, and thereby the high-speed cruise can be realized.

In order to solve the above problem, a Ro-scull according to the invention is characterized by having a Ro-blade (i.e., second scull arm) which has a flat part (i.e., a flat scull blade), one end of the Ro-blade to be located under a water surface; and a Ro-arm (i.e., a first scull arm) which is attached to the other end of the Ro-blade at a position where the Ro-blade is operated with reference to a position where the flat part becomes perpendicular to the water surface.

Further, in a Ro-scull according to the invention, the Ro-blade is joined to a connection part which is joined to a fin parallel to the flat part of the Ro-blade near a distal end portion of the other end of the Ro-blade which is not joined to the Ro-arm.

DESCRIPTION OF REFERENCE NUMERALS

Figure 1:
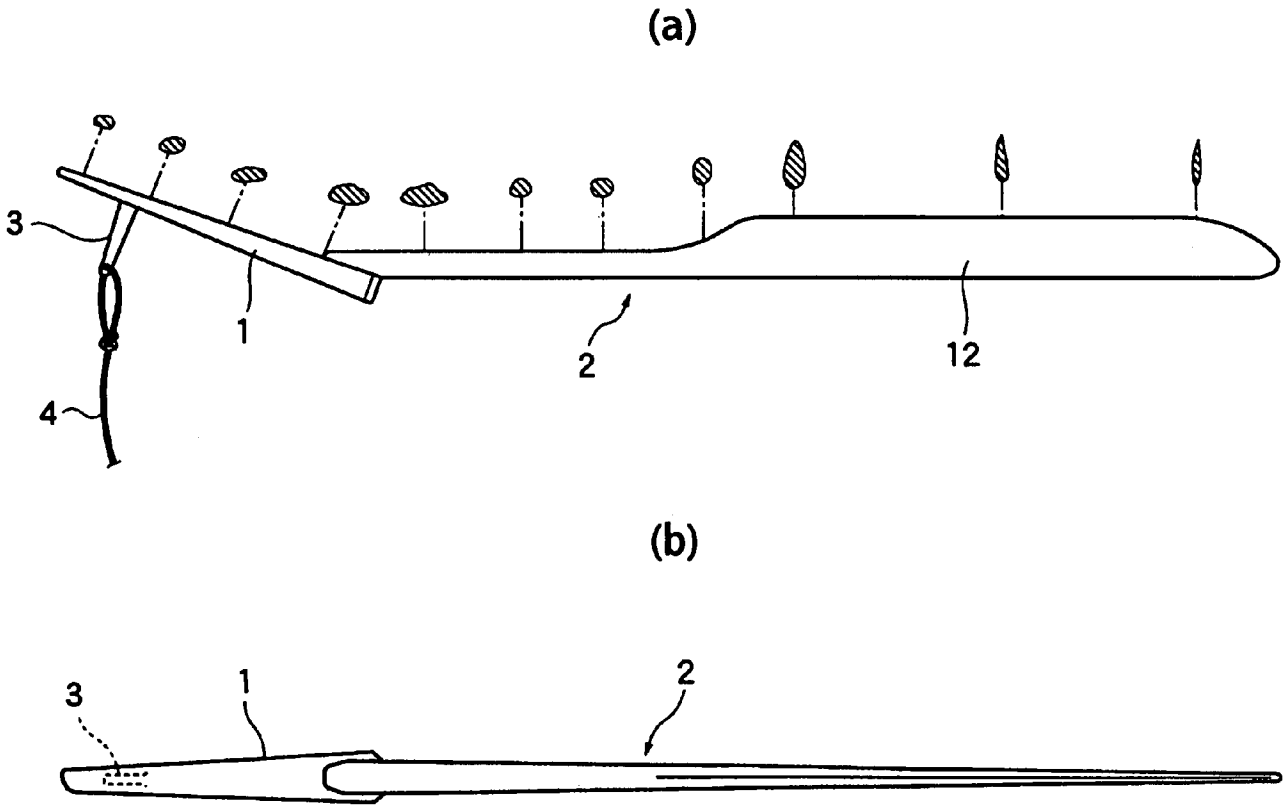
FIG. 1 is a side view and a plan view of a Ro-scull according to an embodiment of the invention.

1 Ro-arm
2 Ro-blade
3 Ro-handle
4 Hayao (support line)
5 fin
6 connection part
7 insert and fit portion

BEST MODE FOR CARRYING OUT THE INVENTION

FIG. 1 is a side view and a plan view of a Ro-scull according to an embodiment of the invention. Incidentally, the cross sections of the Ro-scull at the corresponding points are shown above the side view.

As for the Ro-scull, the Ro-scull of the embodiment differs from the conventional Ro-scull in that the Ro-scull of the embodiment includes a Ro-blade 2 (i.e., a second scull arm 2) having a flat part 12 (i.e., a flat scull blade 12) perpendicular to a Ro-arm 1 (i.e., a first scull arm 1). Because the Ro-scull of the embodiment may be formed when the front edge f is located on the lower side and the rear edge r is located on the upper side, the attachment of the flat part 12 to the Ro-arm 1 is not limited to a perpendicular direction. It is also possible that the flat part 12 is attached substantially perpendicular to the Ro-arm 1. In the conventional Ro-arm 102, the Ro-arm 102 is attached to the Ro-blade 101 while the upper end portion of the Ro-blade 101 is covered with the Ro-arm 102 so that the Ro-arm 102 is set in parallel with the water surface. On the other hand, the Ro-arm 1 of the invention is attached to the upper end portion of the Ro-blade 2 from the obliquely lower side. Namely, the Ro-arm 1 of the invention is characterized in that the Ro-arm 1 and the Ro-blade 2 are fixed to each other while the Ro-arm 1 "receives" the Ro-blade 2. As is apparent from FIG. 1, in the Ro-blade 2 of the Ro-scull according to the invention, like the conventional Ro-blade 101, it is possible that a region where the Ro-blade 2 is joined to the Ro-arm 1 may not be flat part 12. A Ro-handle 3 is arranged not on the upper surface side but on the lower surface side of the Ro-arm.

The flat part has a spatula shape as shown in the cross sectional view of FIG. 1. As shown in the cross sectional view of FIG. 1, the flat part 12 of the Ro-blade 2 has a shape in which the lower portion (front edge f) is thick and the upper portion (rear edge r) is thin. The lower portion (front edge f) of the flat portion 12 becomes thinner toward the distal end side of the Ro-blade 2. As the front edge f is thinned, the distal end side becomes thinner as a whole, and the Ro-blade 2 has the so-called streamline shape in which the rear end portion r is always thinner than the front end portion f (known as symmetrical wing shape with no camber).

Figure 2:
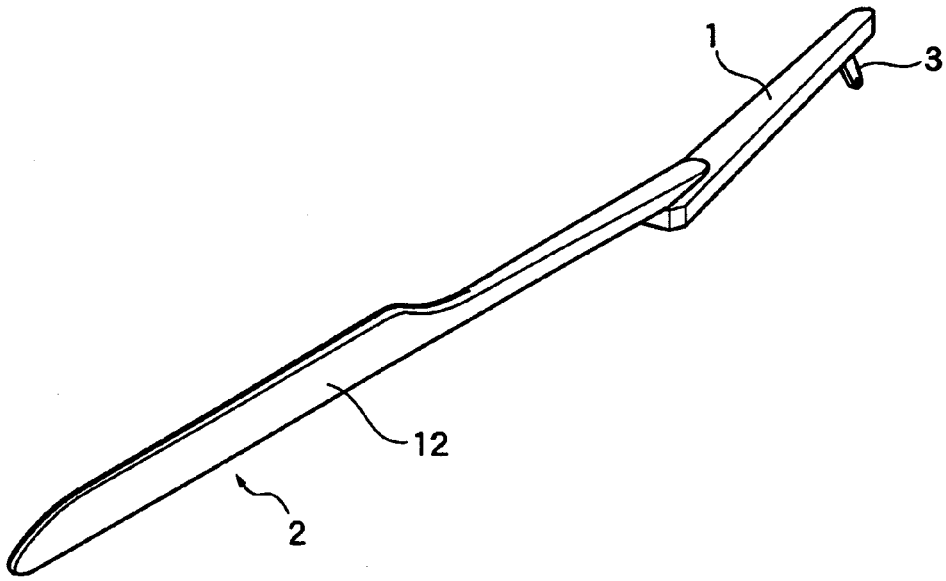
FIG. 2 is a perspective view of the Ro-scull according to the embodiment of the invention.

FIG. 2 is a perspective view of the Ro-scull according to the embodiment. As is apparent from FIG. 2, the surface of the conventional Ro-blade surface is formed with reference to a horizontal state. On the other hand, the Ro-scull of the invention differs from the conventional Ro-scull in that the surface of the Ro-blade of the invention is formed based on the use in the perpendicular state and the Ro-arm 1 and the Ro-blade 2 are fixed to each other while the Ro-arm 1 "receives" the Ro-blade 2.

Further, the Ro-scull of the invention differs from the conventional Ro-scull in that the Ro-handle 3 to which the Hayao (support line) 4 is attached to the lower surface of the Ro-arm 1 (the upper surface of the Ro-arm in the conventional Ro-scull) in order to set the perpendicular state of the flat part of the Ro-blade 2 as the reference. Therefore, the perpendicular state is set as the reference.

Figure 4:
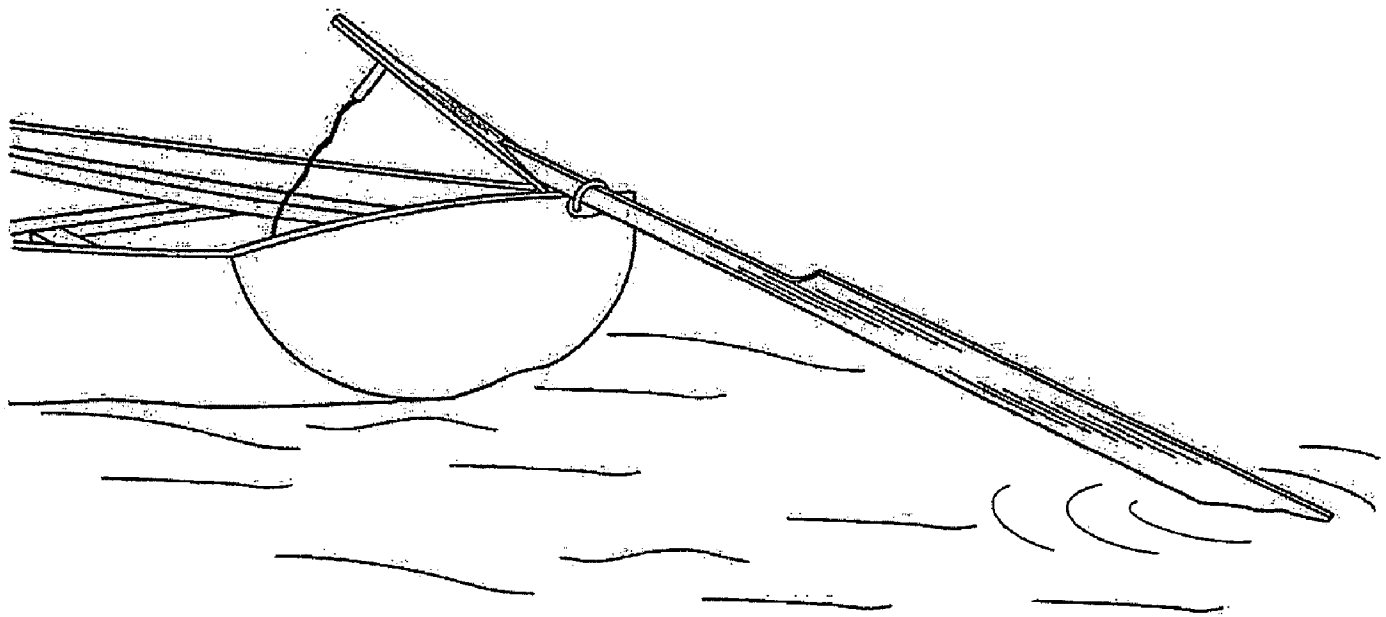
FIG. 4 is a view showing a state in which the Ro-scull according to the embodiment of the invention is mounted on a boat.

FIG. 4 is a view showing a state in which the Ro-scull of the embodiment is mounted on the boat. As can be seen from FIG. 4, the conventional Ro-scull is at a standstill in a reversed V-shape, but on the contrary, it is clear that the Ro-scull of the embodiment is based on a V-shape.

In the embodiment, a part corresponding to the Ireko 120 of the conventional Ro-scull has a relatively high degree of freedom due to the structure, so that the part corresponding to the Ireko 120 may be formed in the support shape of an usual oar.

The action of the Ro-scull formed in the above-described manner will be described.

Figure 3:
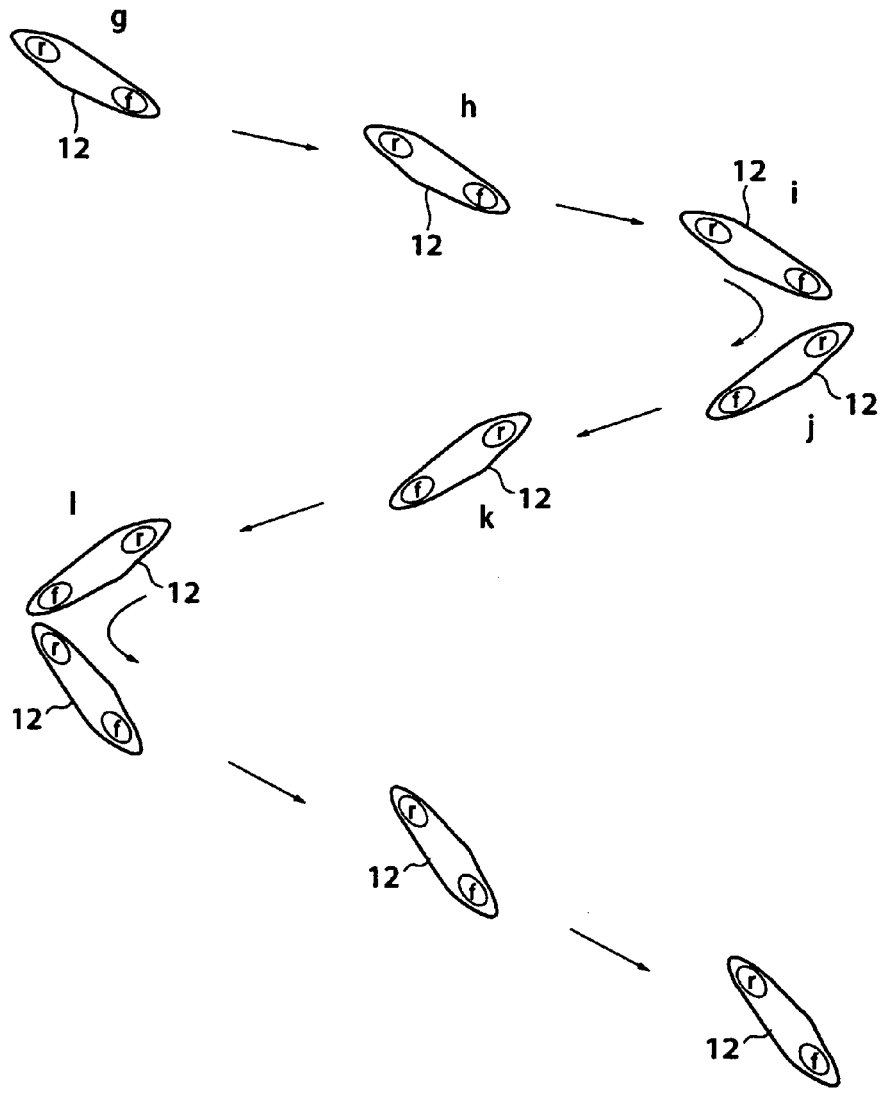
FIG. 3 is a transition view of a Ro-blade when the Ro-scull according to the embodiment of the invention is operated from side to side.

FIG. 3 shows the transition of the Ro-blade 2 when the Ro-scull of the embodiment is operated from side to side. FIG. 3 shows the movement of the cross section of the Ro-blade 2 (flat part 12) in the time-series order at the position where the Ro-blade 2 is in contact with a water surface, when the operator operates the Ro-scull.

Figure 5:
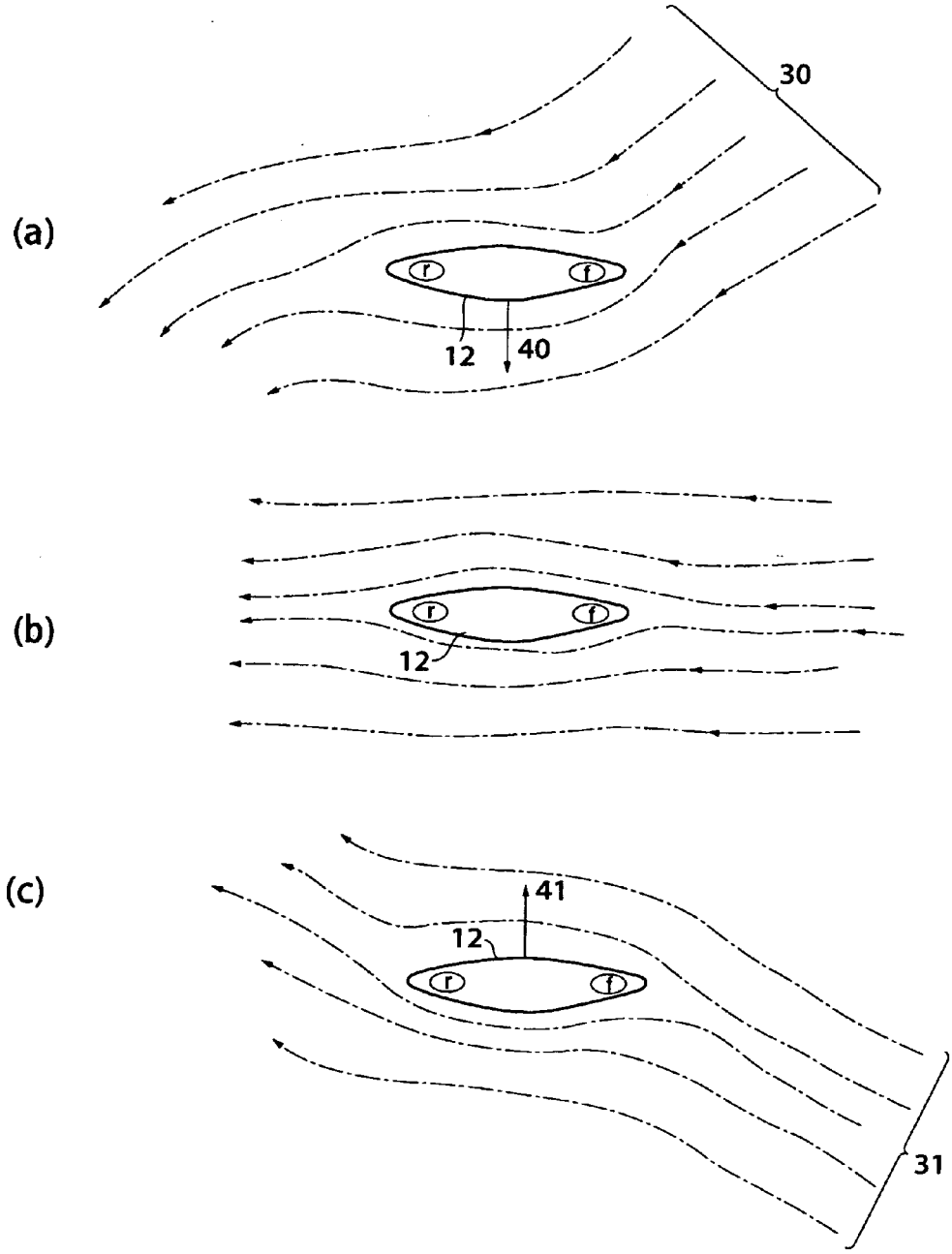
FIG. 5 is an explanatory view explaining a relationship between the Ro-blade of the Ro-scull according to the embodiment of the invention and a water flow.
Figure 6:
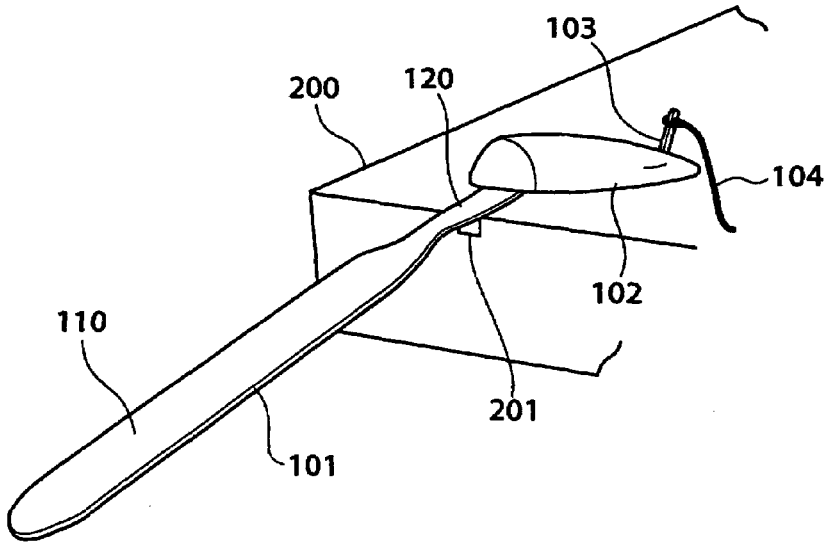
Fig. 6 (PRIOR ART)
FIG. 6 is a perspective view of the conventional Ro-scull.
Figure 7:
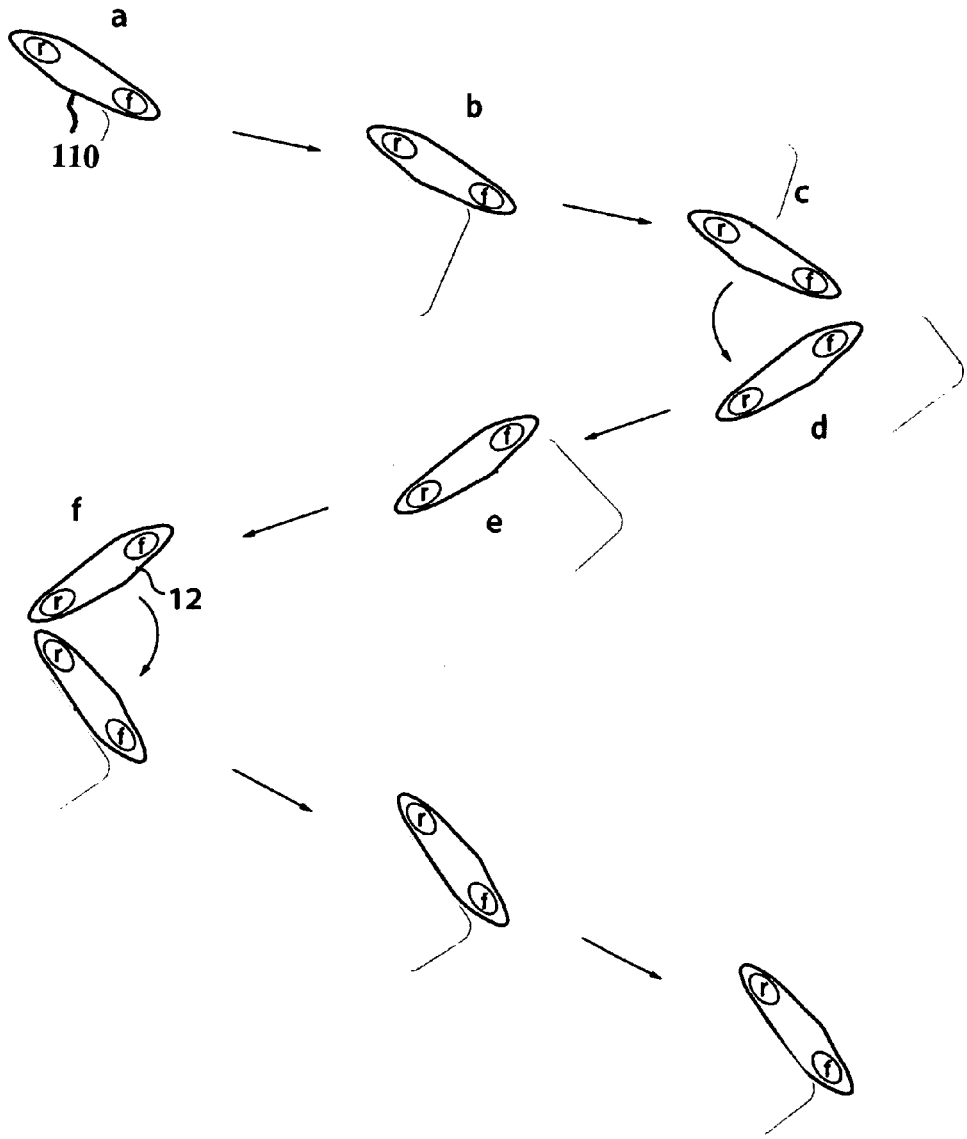
Fig. 7 (PRIOR ART)
FIG. 7 is a transition view of the Ro-blade when the conventional Ro-scull is operated from side to side.
Figure 8:
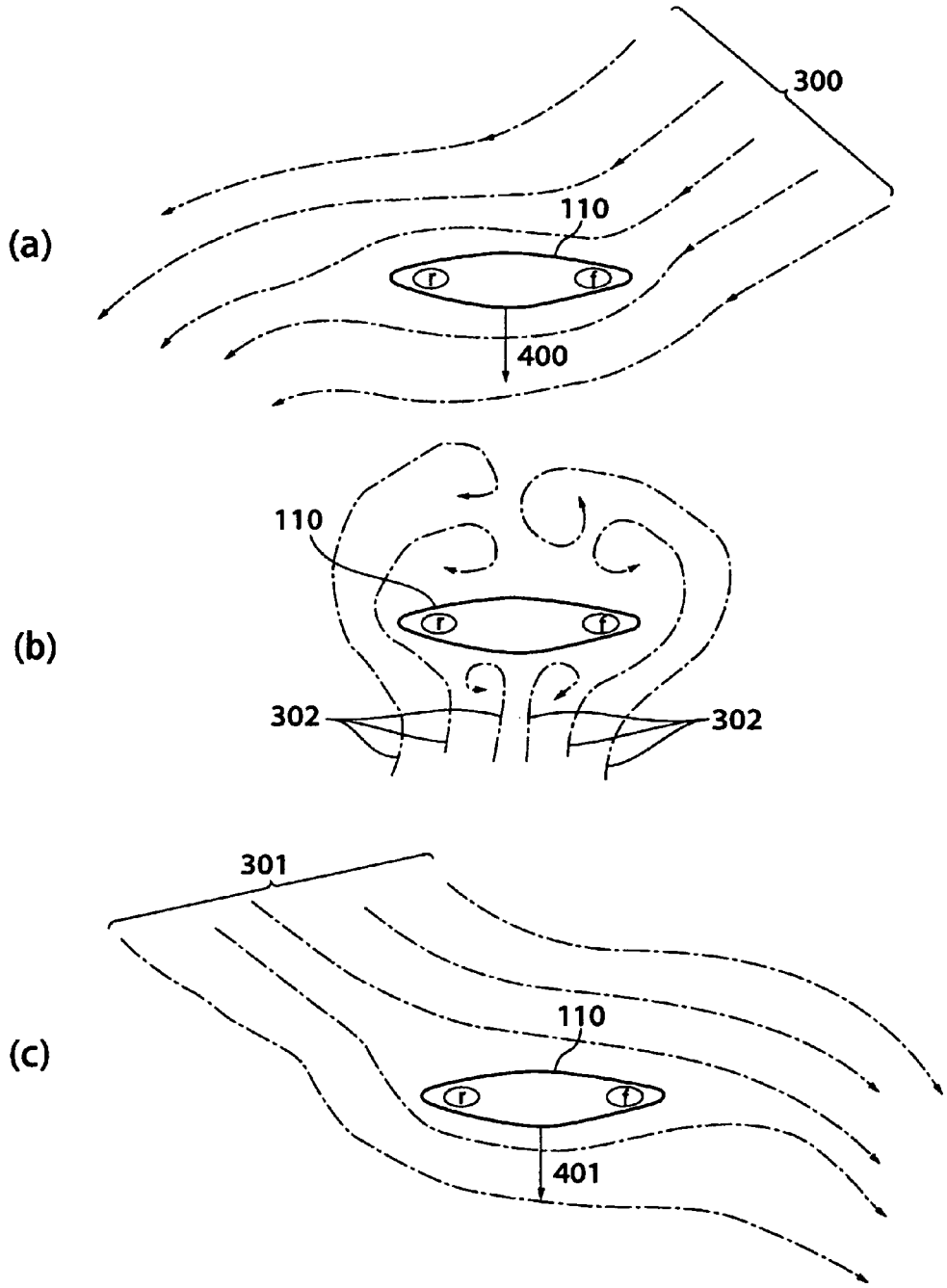
Fig. 8 (PRIOR ART)
FIG. 8 is an explanatory view explaining the relationship between the Ro-blade and the water flow in the conventional Ro-scull.

In g to I of FIG. 3, like the conventional Ro-scull, the Ro-scull is operated while it is inclined in an oblique direction. Namely, the Ro-scull is operated from side to side while the front edge of the flat part 12 of the Ro-scull is always inclined onto the advancing direction. Therefore, as shown in (a) of FIG. 5, a water flow 30 acts on the flat part 12 in the same manner as for the conventional Ro-scull, so that the thrust force is generated in the direction of an arrow 40. For the water flow to the flat part 12 of the Ro-blade 2 in the reversed direction, an incidence angle becomes reversed, and the thrust force is generated in the opposite direction (direction of an arrow 41 in (c) of FIG. 5) to the direction in which the Ro-blade 2 is moved as shown in g to h to i (or leftward).

The part of the turn-over is the feature of the embodiment.

Since the surface of the Ro-scull is perpendicular in a reference attitude of the perpendicular Ro-scull, when turn-over operation of the Ro-scull is performed at a repetitive point, the flat part 12 of the Ro-arm 2 becomes parallel to the water flow. Therefore, as shown in (b) of FIG. 5, the resistance caused by the water flow becomes the minimum. The absence of the resistance means, as a matter of course, that the vortex is hardly generated on any one of the surfaces of the flat part 12 of the Ro-blade 2. Accordingly, the decrease in thrust force caused by the turn-over is hardly generated, so that the high-speed cruise can be realized.

In addition, because only the light force is necessary for the turn-over operation, the operation in which the Ro-scull is operated from side to side can be performed faster when compared with the conventional Ro-scull. Therefore, the cruise performance is also improved.

The second feature of the embodiment is that, as described above, the Ro-blade 2 and the Ro-arm 1 are configured so that the relationship between the Ro-blade 2 and the Ro-arm 1 forms a V-shape when the Ro-scull is at a standstill.

The V-shaped relationship between the Ro-blade 2 and the Ro-arm 1 facilitates the appropriate turn-over of the Ro-blade 2 at a respective point of the Ro-scull of the embodiment.

Namely, the first motion of the turn-over operation generates rotation moment about an axis of the Ro-blade 2 in the water to naturally introduce the appropriate turn-over angle.

Further, the third feature is that the Ro-handle 3 is projected from the lower side of the Ro-arm 1. The Hayao 4 is tied at the distal end of the Ro-handle so that the angle of the Ro-scull surface does not become excessive.

Thus, the incidence angle can be controlled so as not to be excessively increased, and the appropriate incidence angle can be substantially, automatically obtained according to the speed of the boat.

The term of incidence angle means the relative angle formed by a main water stream (the stream at the center of the water stream) and the cross section of the Ro-scull.

In the embodiment, the Ro-blade 2 and the Ro-arm 1 are obliquely attached to each other, but as a result of examinations of the inventor, it is optimum that the attachment angle ranges about 7 degrees to 15 degrees.

Figure 9:
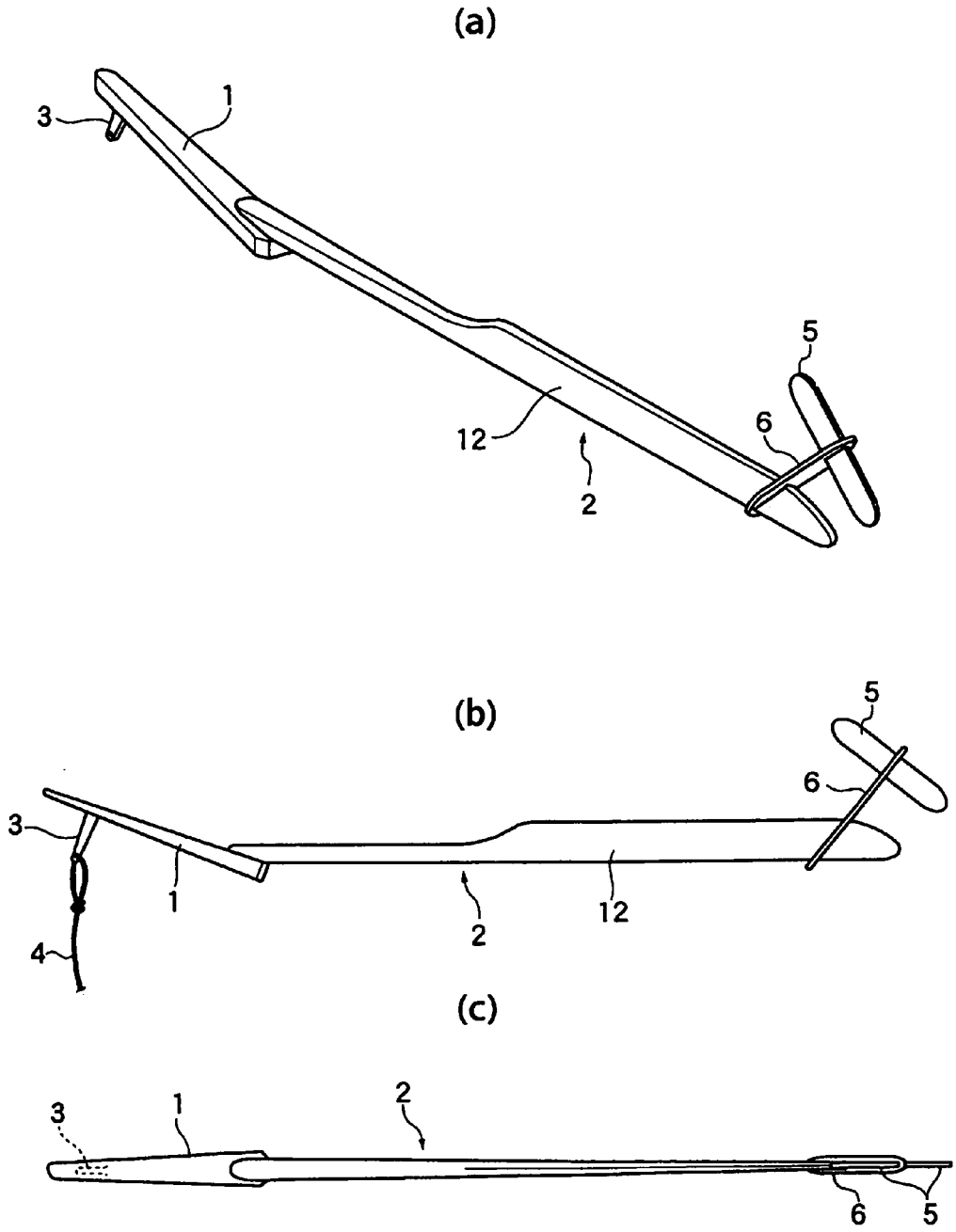
FIG. 9 is a view showing a Ro-scull to which a fin according to the invention is attached.
Figure 12:
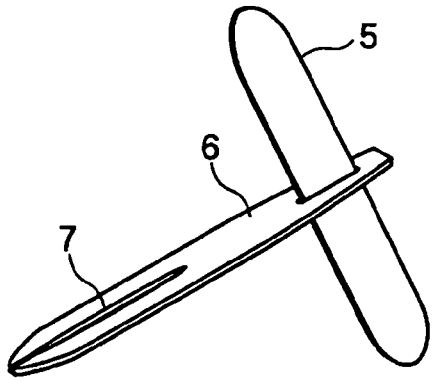
FIG. 12 is a view showing the fin and a connection part.
Figure 12:
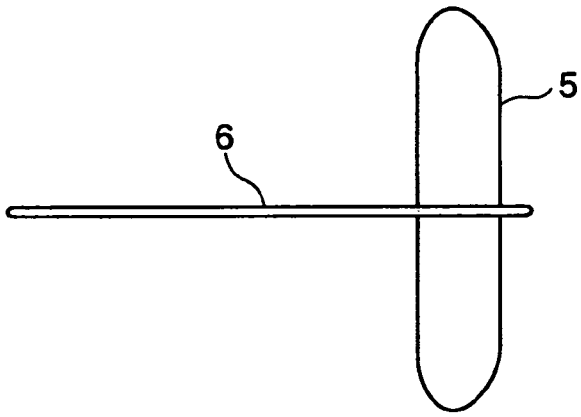
Figure 12:
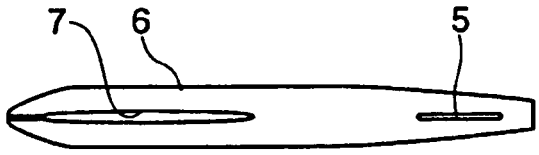

Then, a second embodiment according to the Ro-scull of the invention, the Ro-scull further with a fin 5 will be described. FIG. 9 shows the Ro-scull of the second embodiment. (a) of FIG. 9 is a perspective view, (b) of FIG. 9 is a side view, and (c) of FIG. 9 is a plan view. FIG. 12 shows the fin 5 and a connection part 6. The fin 5 is joined to the connection part 6, and the connection part 6 includes an insert and fit portion 7 which can be inserted and fitted into the flat part 12 The insert and fit portion 7 is inserted and fitted into the flat part 12 so that the fin 5 is positioned above the Ro-blade 2 (as shown in FIG. 9).

Figure 11:
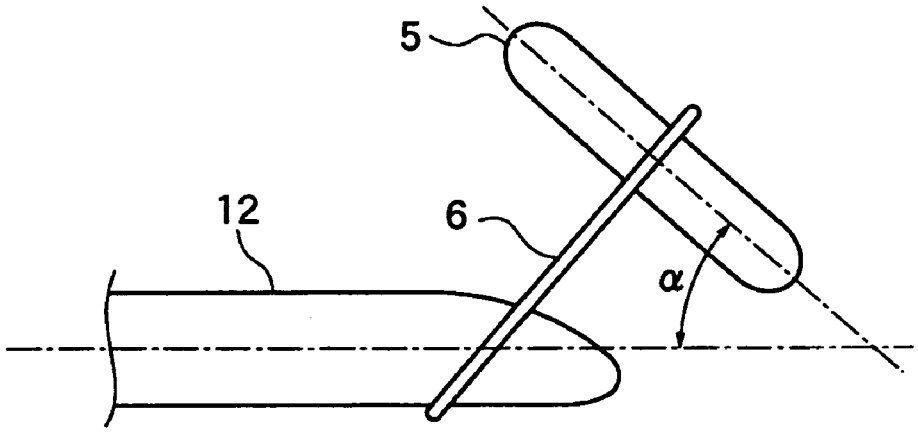
FIG. 11 is an enlarged view of a distal end portion of the Ro-blade to which the fin is attached.

When the flat part 12 is viewed from a side (i.e. in the case of the side view of (b) of FIG. 9), because the Ro-blade 2 is put in the water while the angle formed by the Ro-blade 2 and the water surface ranges from about 30 to 50 degrees, it is preferable that the angle $\alpha$ formed by an extension line of the fin 5 and the Ro-blade 2 (see FIG. 11) ranges from about 40 to 60 degrees (90 degrees−50 degrees$\leqq$angle $\alpha\leqq$90 degrees−30 degrees).

Figure 10:
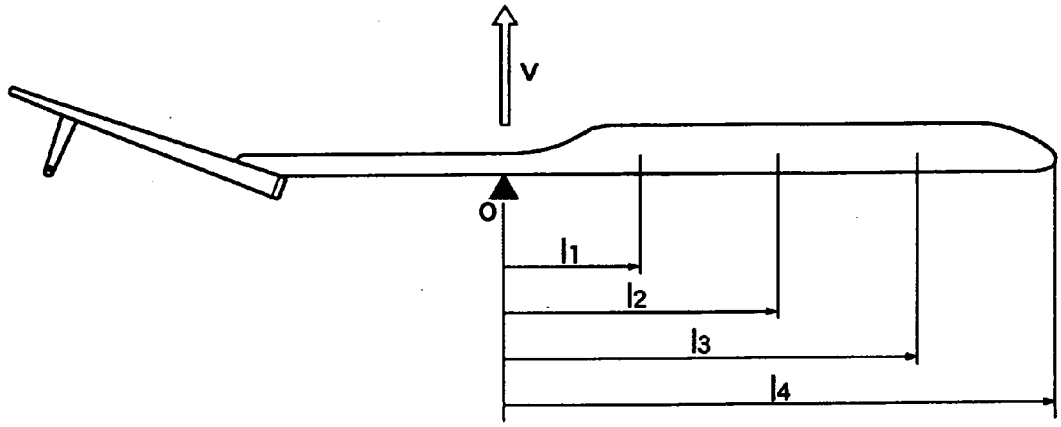
FIG. 10 is a conceptual view of the Ro-scull and advancing speed.
Figure 10:
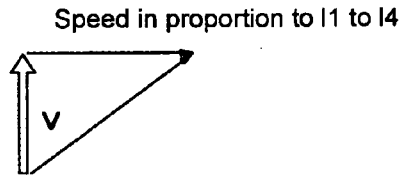

When the thrust force of the boat is obtained by using the Ro-scull, as a matter of course, the advancing speed of the boat is the same at any portion of the boat. However, as shown in (a) of FIG. 10, the speed of swing from side to side of the Ro-scull is proportional to a length l from a fulcrum O. Accordingly, the speeds are different from one another at each point of the distances $l_1$, $l_2$, $l_3$, and $l_4$ from the fulcrum O. When the advancing speed of the boat is set at v, as shown in (b) of FIG. 10, it is found that the relative speed of the water flow and the incidence angle vary with the distance from the fulcrum O.

In the case of the Ro-scull as explained above, if twisting does not occur in the Ro-scull, the water flow having the constant speed is generated in parallel with the advancing direction by the movement of the boat, but since the moving speed (in the direction perpendicular to the advancing direction) becomes larger at the distal end of the Ro-scull, both the relative speed of the water flow hitting the Ro-scull and the incidence angle are increased, which unnecessarily increases the drag at the distal end portion of the Ro-blade 2. Namely, the waste is increased.

Therefore, as shown in FIG. 9, the fin 5 is further attached to the distal end of the Ro-blade 2 (flat part 12), which allows the Ro-blade 2 to be automatically bent toward the direction in which the incidence angle at the distal end is decreased.

Figure 15:
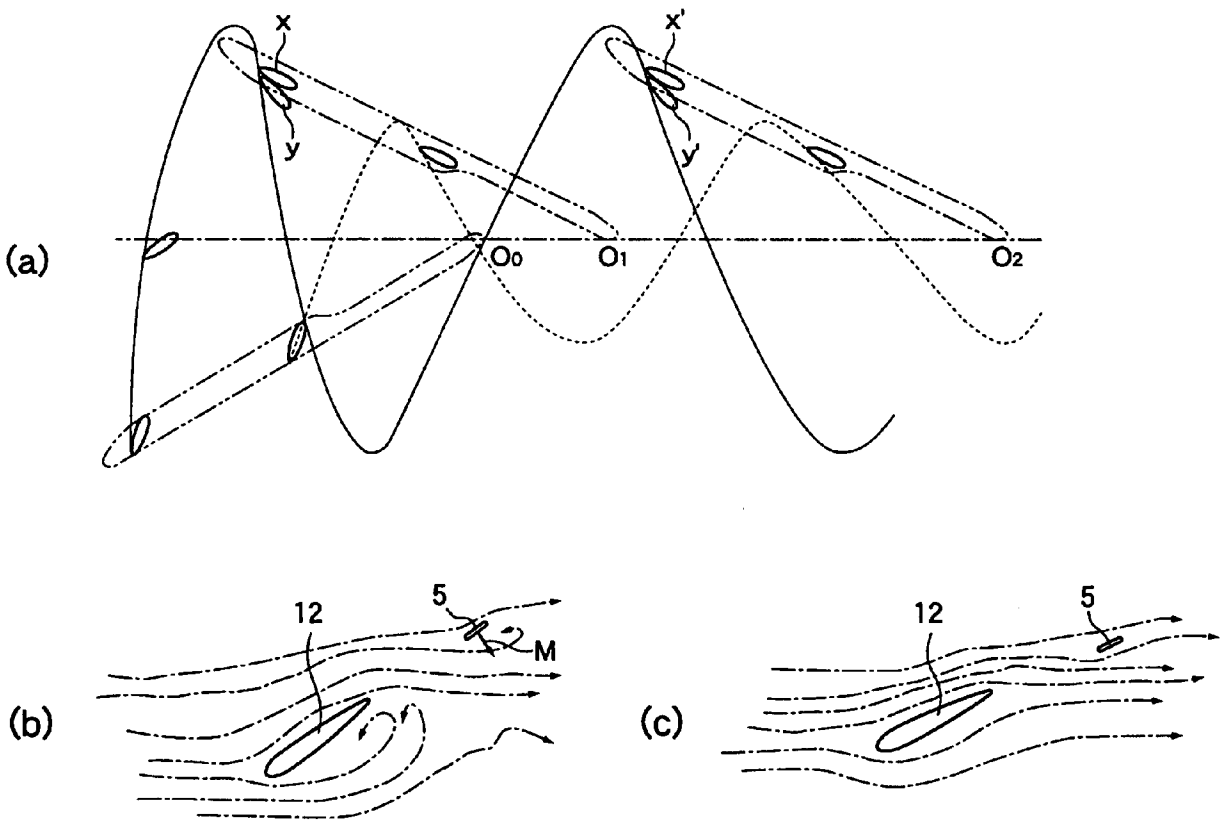
FIG. 15 is a view showing adjustment of an incidence angle with respect to the distal end of a Ro-blade 2 when the fin is attached to the Ro-scull.

FIG. 15 is a view showing adjustment of the incidence angle with respect to the distal end of the Ro-blade 2 (flat part 12), when the fin is attached to the Ro-scull. (a) of FIG. 15 shows how the Ro-scull is changed from the fulcrum O of the boat at the position where the Ro-scull is in contact with the water surface, and at the position near the distal end of the Ro-blade, by the cross section of the Ro-scull at each position. A locus shown by a solid line indicates the locus of the cross section near the distal end of the Ro-blade 2, and a locus shown by a broken line is the locus of the cross section at the position where the Ro-scull is in contact with the water surface. When the operator operates from side to side the Ro-scull on the fulcrum O, the Ro-scull advances toward the advancing direction (in FIG. 15, the Ro-scull advances from the left side to the right side), which also allows the fulcrum O to advance toward the advancing direction (from the left side to the right side).

In the case where the boat is located at the position of the fulcrum $O_1$, or in the case where the boat is located at the position of the fulcrum $O_2$ which is one stroke ahead of the fulcrum $O_1$, the cross section (x in the fulcrum $O_1$ and X' in the fulcrum $O_2$) near the distal end of the Ro-blade 2 becomes parallel to the cross section at the position where the Ro-scull is in contact with the water surface, when the fin 5 is not attached to the Ro-blade 2. However, as described above, the position near the distal end of the Ro-blade 2 differs from the position where the Ro-scull is in contact with the water surface in the relative speed, so that the water vortexes are generated to increase the drag as shown in (b) of FIG. 15 (for the purpose of illustration, the connection part 6 is deleted in (b) and (c) of FIG. 15).

However, when the fin 5 is attached to the portion near the distal end of the Ro-blade 2, due to the water resistance against the fin 5, the distal end of the Ro-blade 2 is bent toward the direction in which the incidence angle is decreased. Therefore, the position near the distal end of the Ro-blade 2 is bent from x to y and from x' to y' (the angles between x and y and between x' and y' range from about two degrees to seven degrees). Namely, the incidence angle at the distal end portion of the Ro-blade 2 is automatically decreased by utilizing bending moment applied to the fin 5. As a result, the ideal incidence angle is obtained along the total length of the Ro-blade 2, and the drag caused by the water flow is decreased as shown in (c) of FIG. 15.

Since the Ro-blade 2 is bent by the fin 5, it is preferable that the Ro-blade is made of flexible material and yet having strength to a certain degree. Wood, FRP, carbon fiber, the light metal can be cited as examples of the material for the Ro-blade 2.

For the Ro-scull shown in FIG. 9, the fin 5 is joined to the Ro-blade 2 through the connection portion 6. However, it is also possible that the fin 5 is directly joined to the distal end portion of the Ro-blade 2 without the connection portion 6 being provided.

Thus, when the fin 5 is provided in the Ro-blade 2, because it is experimentally found that the fin 5 always acts in the direction in which the incidence angle is decreased irrespective of the rowing direction of the Ro-scull, the drag at the distal end portion of the Ro-blade 2 is decreased. Therefore, the force necessary for the rowing of the Ro-scull is decreased, and in addition the thrust force is increased, which allows the boat to advance at a high speed when compared with the case where the fin 5 is not attached to the scull.

Figure 13:
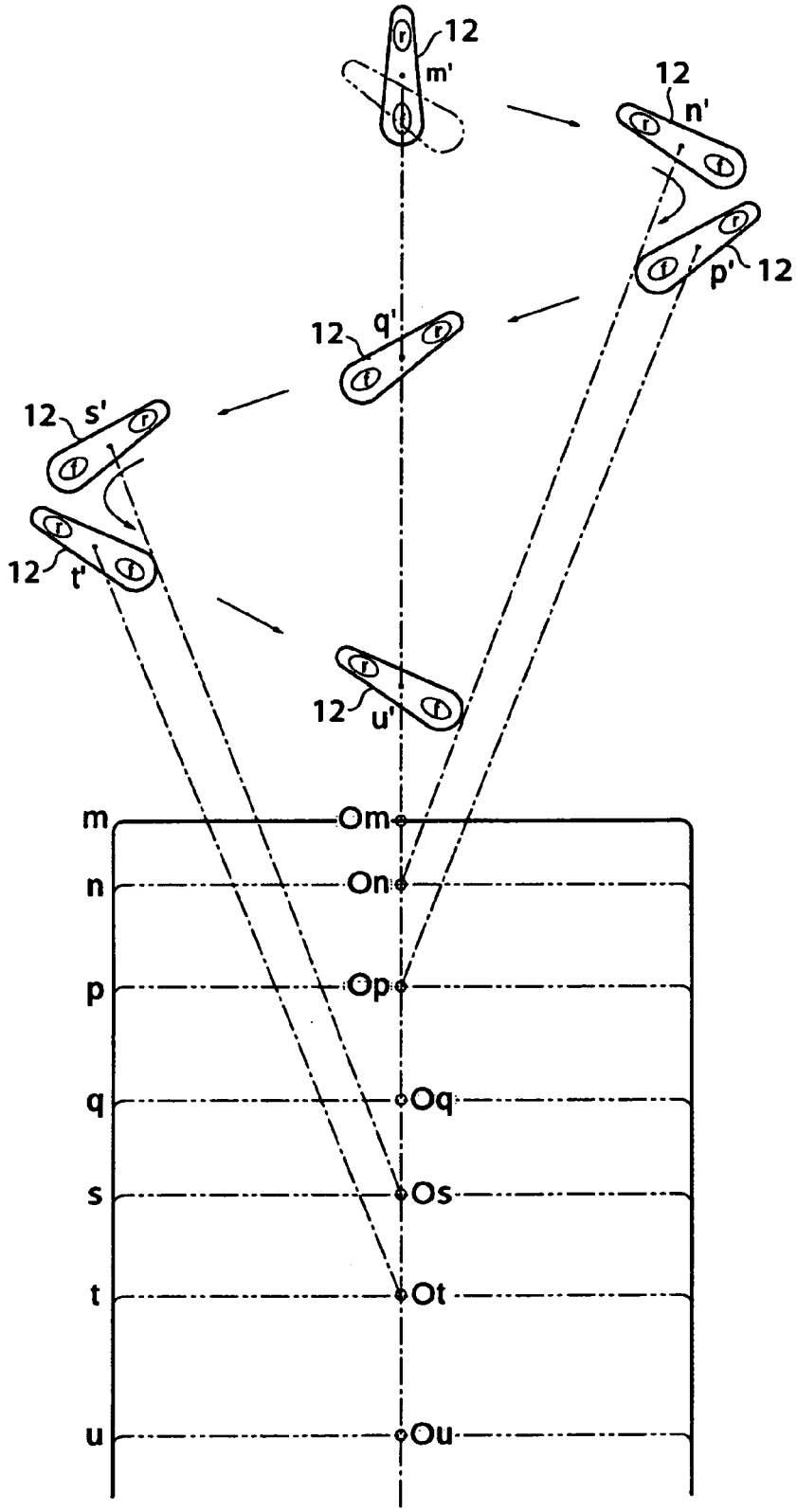
FIG. 13 is a transition view of the Ro-blade when the Ro-scull, to which the fin is attached, is operated from side to side.

The action of the Ro-scull will be described in detail while FIG. 13 shows the movement of the cross section of the Ro-blade 2 (flat part 12) at the position where the Ro-blade 2 is in contact with the water surface in the time-series order when the operator operates the Ro-scull in which the fin 5 is attached to the Ro-blade 2. The Ro-scull acts in the same manner irrespective of the attachment of the fin 5 to the Ro-blade 2.

In FIG. 13, the sign O denotes the fulcrum of the Ro-scull attached onto the boat, and the broken line indicates an imaginary line of the Ro-scull with respect to the Ro-blade 2 which is in contact with the water surface. Accordingly, the operator can move the scull from side to side on the fulcrum O.

First, it is assumed that the Ro-blade 2 is positioned at m' when the rear portion of the boat (lower portion of the figure) in which the Ro-scull is supported on the fulcrum O is located at m. At this point, because the operator does not move the Ro-scull, the Ro-blade 2 is located perpendicular to (substantially perpendicular to) the boat.

Then, the operator of the Ro-scull moves the Ro-arm 1 so that the front edge f of the flat part 12 of the Ro-blade 2 is faced toward the advancing direction (it is assumed that the advancing direction of the boat is the lower side of the figure) (It is possible that the Ro-blade 2 is moved in either the right direction or the left direction, but in FIG. 13, the operator moves the Ro-scull, such that the Ro-blade 2 is moved on the fulcrum O from the right side to the left side with respect to the advancing direction of the boat, and such that the Ro-arm 1 is moved on the fulcrum O from the left side to the right side with respect to the advancing direction of the boat).

Figure 14:
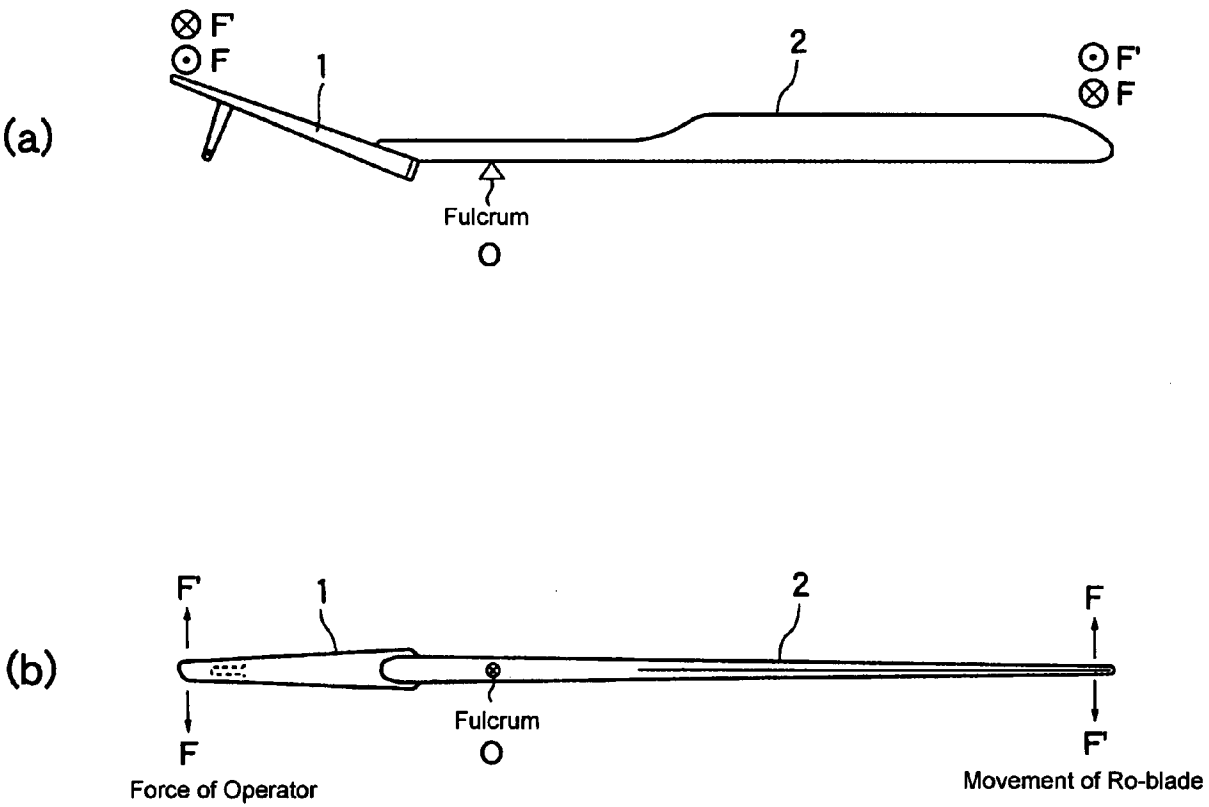
FIG. 14 is a conceptual view showing forces applied to the Ro-scull.

FIG. 14 is a side view ((a) of FIG. 14) when the operator applies the force to the Ro-scull, and a plan view ((b) of FIG. 14) when the operator applies the force to the Ro-scull. In the operation described above, since the operator applies force F' to the Ro-arm 1 on the fulcrum O, the Ro-blade 2 is rotated in the reverse direction by the force F' on the fulcrum O.

At this point, the Ro-arm 1 overcomes the water resistance received by the Ro-blade 2, and the Ro-arm 1 starts the lateral movement. Because the Ro-arm 1 has the upper angle relative to the Ro-blade 2 (preferably ranging from 7 degrees to 15 degrees), the rotational movement is induced about the longitudinal direction (on the extension line of the Ro-blade 2) of the Ro-blade 2 in the water.

Then, the force with which the operator pushes laterally the Ro-arm 1 acts on the upper side of the rotation axis in the longitudinal direction, so that the distal end of the Ro-arm 1 is pressed forward. Namely, when viewed from the Ro-blade 2, the front edge f of the Ro-blade 2 is automatically rotated in the desired rotation direction. In FIG. 13, when the operator applies the force F' to the Ro-arm 1 on the fulcrum O so that the Ro-blade 2 is moved from the left side to the right side with respect to the advancing direction of the boat, the Ro-blade 2 is moved on the fulcrum O from the right side to the left side (from the position m' to the position n') with respect to the advancing direction of the boat, and the position of the boat also advances from the position m to the position n by the thrust force obtained by the Ro-scull.

The rotation of the Ro-blade 2 is continued until the front edge f becomes parallel to the water flow in the advancing direction with respect to the Ro-blade 2 which is freely moved, and the thrust force is generated until the front edge f becomes parallel. When the front edge f becomes parallel, the thrust force is not generated, but, because the thrust force generated at an early stage of the rotation of the Ro-blade 2 gives tension force to the Hayao 4, the rotation is stopped in the midway, and the Ro-blade 2 is stabilized in the water at the appropriate incidence angle.

The effect that stabilizes the incidence angle is generated by coupling the Hayao 4 to the distal end of the Ro-handle 3 attached to the lower surface of the Ro-arm 1.

Accordingly, the lateral force generated by the operator acts in the direction in which the incidence angle of the Ro-blade 2 is decreased, and the tension force of the Hayao 4 acts in the direction in which the incidence angle is increased, so that the operator can easily operate the Ro-scull.

In the position of the Ro-arm 1, since the moving range from side to side is restricted by the Hayao 4, when the Ro-blade 2 reaches the position of n, the "turn-over" operation is performed so that the front edge f of the Ro-blade 2 is faced toward the advancing direction side. In this case, the operator applies the force F which is opposite to the force F' to the Ro-arm 1 (the force on the fulcrum O from the right side to the left side with respect to the advancing direction of the boat), which allows the boat and the position of the Ro-blade 2 to reach p and p'.

Because the operator moves the Ro-arm 1 with the force F from the right side to the left side with respect to the advancing direction of the boat, the Ro-blade 2 is moved on the fulcrum O from the left side to the right side (from the position p' to the position s' through the position q') by the same action as described above.

Like the transition from the position n' to the position p', the "turn-over" operation is performed at the position s' so that the front edge f of the Ro-blade 2 is faced toward the advancing direction side, which applies the force F' to the Ro-arm 1. Therefore, the boat and the position of the Ro-blade 2 are moved from positions s and s' to the positions t and t'. Then, as with the transition from the position m' to the position n', the operator applies the force F' to the Ro-arm 1 from the left side to the right side with respect to the advancing direction of the boat, which allows the boat and the Ro-blade 2 to be moved from the positions t and t' to the positions u and u'.

Thus, the operator moves the Ro-arm on the fulcrum O of the boat from side to side, which allows the boat to obtain the thrust force to advance toward the advancing direction.

When the fin 5 is attached to the Ro-scull, in the turn-over operation (the operation from the position n to the position p, and the operation from the position s to the position t), the distal end of the Ro-blade 2 (flat part 12) is bent by the water resistance against the fin 5, so that the ideal incidence angle is obtained along the total length of the Ro-blade 2. Therefore, the resistance against the Ro-blade 2 is decreased, and the thrust force is increased.

INDUSTRIAL APPLICABILITY

The invention is characterized by having the Ro-arm rigidly fixed to the other end of the Ro-blade at the position, where the flat part comes to a standstill so as to become perpendicular to the water surface, and therefore, in the turn-over operation, the water resistance against the Ro-blade is largely decreased when compared with the conventional Ro-scull, which allows the decrease in thrust force by the water resistance to be prevented. Further, the force caused by the water resistance is decreased during the turn-over operation, which allows the Ro-scull to be operated at a high speed. Therefore, when compared with the conventional Ro-scull, the Ro-scull of the invention can propel the boat at a high speed.

The invention claimed is:

1. A sculling oar to generate a thrust force of a boat by an operation by an operator from side to side, the sculling oar comprising:

a first scull arm to be operated by an operator; and a second scull arm having a flat scull blade extending substantially perpendicular to a water surface when the sculling oar is attached to the boat;

wherein the second scull arm is joined to the first scull arm such that the first scull arm is positioned substantially above a longitudinal axis of the second scull arm.

2. The sculling oar according to claim 1, wherein the first scull arm and the second scull arm are joined at a position to form a V-shape with respect to the water surface.

3. The sculling oar according to claim 1, wherein the first scull arm and the second scull arm are joined such that the first scull arm forms an angle of seven degrees to ten degrees with respect to the second scull arm.

4. The sculling oar according to claim 1, wherein a front edge of the flat scull blade is thicker than a rear edge of the flat scull blade, and the front edge is always positioned on an advancing direction side with respect to the rear edge when the operator operates the first scull arm.

5. The sculling oar according to claim 1, wherein an area near a part where the first scull arm and the second scull arm are joined has a round shape.

6. The sculling oar according to claim 1, wherein one end of the first scull arm is joined to a scull handle for attaching thereto a rope fixed to the boat.

7. The sculling oar according to claim 1, wherein a connection part is joined to a distal end portion of the flat scull blade, and the connection part is joined to a fin parallel to distal end portion of the flat scull blade.

8. The sculling oar according to claim 7, wherein the fin is positioned above the flat scull blade.

9. The sculling oar according to claim 8, wherein an angle $\alpha$ formed by an extension line of the fin and an extension line of the flat scull blade ranges from about 40 degrees to about 60 degrees.

10. The sculling oar according to claim 7, wherein an angle $\alpha$ formed by an extension line of the fin and an extension line of the flat scull blade ranges from about 40 degrees to about 60 degrees.

11. The sculling oar according to claim 1, wherein the material of the second scull arm is any one of wood, FRP, carbon fiber, and light metal.

* * * * *